US009570829B2

(12) United States Patent
Wimmer

(10) Patent No.: US 9,570,829 B2
(45) Date of Patent: Feb. 14, 2017

(54) PLUG CONNECTOR AND MATING CONNECTOR

(71) Applicant: Lisa Draexlmaier GmbH, Vilsbiburg (DE)

(72) Inventor: Wolfgang Wimmer, Salching (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 14/923,354

(22) Filed: Oct. 26, 2015

(65) Prior Publication Data

US 2016/0118725 A1 Apr. 28, 2016

(30) Foreign Application Priority Data

Oct. 27, 2014 (DE) ..... 10 2014 115 595

(51) Int. Cl.

| | |
|---|---|
| ***H01R 13/187*** | (2006.01) |
| ***H01R 13/18*** | (2006.01) |
| ***H01R 13/193*** | (2006.01) |
| ***H01R 4/48*** | (2006.01) |

(52) U.S. Cl.

CPC ..... *H01R 13/187* (2013.01); *H01R 4/48* (2013.01); *H01R 13/18* (2013.01); *H01R 13/193* (2013.01)

(58) Field of Classification Search

CPC ..... H01R 13/187

See application file for complete search history.

(56) References Cited

U.S. PATENT DOCUMENTS

| | | | | |
|---|---|---|---|---|
| 2,427,001 | A | 10/1947 | Hubbell et al. | |
| 3,380,017 | A * | 4/1968 | Gomulka | H01R 13/33 439/718 |
| 3,440,333 | A * | 4/1969 | Blomstrand | H01R 4/22 174/87 |
| 4,245,881 | A * | 1/1981 | Michaels | H01R 13/187 439/841 |
| 5,154,626 | A | 10/1992 | Watson | |
| 5,439,393 | A * | 8/1995 | Watson | H01R 13/193 439/268 |
| 5,628,644 | A * | 5/1997 | Szalay | H01R 13/193 439/263 |

(Continued)

FOREIGN PATENT DOCUMENTS

| | | | |
|---|---|---|---|
| JP | 2010129358 | A | 6/2010 |
| WO | WO 2014/203758 | A1 | 12/2014 |
| WO | WO 2015/046212 | A1 | 4/2015 |

*Primary Examiner* — James Harvey

(74) *Attorney, Agent, or Firm* — Finnegan, Henderson, Farabow, Garrett & Dunner LLP

(57) ABSTRACT

A plug connector may comprise an expanding ring, a plug contact element, a first connector housing stop, and a locking ring. The plug contact element may comprise a coil spring with a first end and a second end, where the second end of the coil spring may be coupled to the expanding ring. The first connector housing stop may be configured to absorb a pressure in a first rotational direction and block the first end of the coil spring from rotating in the first rotation direction. The locking ring may be configured to absorb a pressure in a second rotational direction opposite the first rotational direction. The locking ring may be configured to block the expanding ring when the plug connector is in an open state and unblock the expanding ring when the plug connector is in a closed state.

18 Claims, 13 Drawing Sheets

(56) References Cited

U.S. PATENT DOCUMENTS

| | | | | |
|---|---|---|---|---|
| 7,901,233 | B2 | 3/2011 | Melni | |
| 2013/0012047 | A1 | 1/2013 | Ishikawa et al. | |
| 2016/0118725 | A1 * | 4/2016 | Wimmer ..... | H01R 4/48<br>439/660 |

* cited by examiner

PLUG CONNECTOR AND MATING CONNECTOR

CROSS REFERENCE TO RELATED APPLICATION

This application is based upon and claims the benefit of prior German Patent Application No. 10 2014 115 595.5, filed on Oct. 27, 2014, the entire contents of which are incorporated herein by reference.

TECHNICAL FIELD

The present disclosure relates to a plug connector for connecting a plug contact element of the plug connector to a mating plug contact element of a mating connector, wherein the plug contact element may comprise a coil spring that has a first end and a second end and is capable of contracting such that the pressure thereof electrically and mechanically connects the plug contact element and the mating plug contact element to each other. The present disclosure further relates to a mating connector that fits the plug connector.

BACKGROUND OF THE DISCLOSURE

U.S. Pat. No. 3,440,333 describes a coil spring that blocks itself in an open state so it is expanded. When strands are pushed into the coil spring and strike against a stop at the end of the coil spring, the blocked state may be lifted and the coil spring may contract. Due to the triangular shape of the wire of which the coil spring is made, the coil spring may dig into the strands and may provide high extraction forces.

But U.S. Pat. No. 3,440,333 has a variety of drawbacks. The strands placed into the coil spring may not be stable enough to reliably trigger the closing mechanism and may potentially fan out under the pressure. The triangular cross-section of the wire of which the coil spring is made may result in convolution impressions on the strands. The surface of the strands may therefore be damaged, which may result in an increased tendency toward corrosion. Moreover, the coil spring may slide away in the housing and not be opened any longer once it has been closed.

SUMMARY

Embodiments of the present disclosure provide an improved plug connector having a coil spring. Moreover, a complementary mating connector for the aforementioned plug connector is provided.

Embodiments of the present disclosure provide a plug connector that may electrically connect a plug contact element of the plug connector to a mating plug contact element of a mating connector. The plug contact element of the plug connector may comprise a coil spring having a first end and a second end, wherein the first end of the coil spring may be blocked by a first connector housing stop for absorbing a pressure in a first rotational direction. The second end of the coil spring may be coupled to an expanding ring.

The plug connector may have an open state and a closed state. In the open state, the expanding ring may be blocked by a stop for absorbing a pressure in a second rotational direction. The second rotational direction may be opposite the first rotational direction. The blockage may cause the coil spring to be expanded such that the mating plug contact element can be introduced into the plug contact element of the plug connector. In the closed state the expanding ring may be decoupled and unblocked from the aforementioned stop. As a result, the coil spring contracts, whereby the pressure of the same may electrically and mechanically connect the plug contact element of the plug connector and the mating plug contact element to each other. According to the present disclosure, the expanding ring may be designed and arranged such that it is pressed by the mating connector in a plug-in direction of the mating connector when the plug connector, while in the open state, and the mating connector are plugged into each other. The expanding ring may be decoupled from the stop by the plug-in process, so that the plug connector switches from the open state to the closed state.

The expanding ring may not be pressed in the plug-in direction of the mating connector until toward the end of the plug-in motion. Thus, a large insertion depth may be ensured. As a result of the mechanism, a switch from the open to the closed state can be made by plugging the plug connector and the mating connector into each other.

The expanding ring may provide an effective trigger surface. The trigger surface of the expanding ring may be larger and more defined in terms of the position thereof. Further, the trigger surface may not have to be actuated by some strands. A housing element of the mating connector may also make contact with the trigger surface.

In some embodiments, the expanding ring may comprise a first expanding ring stop that may absorb a pressure in a first rotational direction and a second expanding ring stop for absorbing a pressure in a second rotational direction. The second end of the coil spring may then be seated against the second expanding ring stop or joined thereto. In the open state of the connector, the first expanding ring stop may be blocked by the stop. The first expanding ring may be decoupled from the stop in the closed state of the connector. The first expanding ring stop may be situated on a first side of the expanding ring, and the second expanding ring stop may be situated on a second side of the expanding ring.

The plug connector may comprise a connector housing, which may not only provide the first connector housing stop, but also may provide a second connector housing stop for absorbing a pressure in the second rotational direction. The above-mentioned stop can then be formed directly by the second connector housing stop, for example.

In one embodiment, the plug connector may also comprise a locking ring so as to achieve easier producibility of the connector. The locking ring may have a first locking ring stop for absorbing a pressure in a first rotational direction and a second locking ring stop for absorbing a pressure in a second rotational direction. The first locking ring stop may be blocked by the second connector housing stop. In the open state of the plug connector, the first expanding ring stop may be seated against and coupled to the second locking ring stop, while the first expanding ring stop may be decoupled from the locking ring stop in the closed state of the plug connector.

In some embodiments, the locking ring may comprise multiple first locking ring stops, and the connector housing may comprise multiple second connector housing stops. In this way, the force acting on the locking ring may be distributed more evenly into the connector housing, whereby tilting of the locking ring is reduced.

For each first locking ring stop, the connector housing can comprise a first guide groove extending in a plug-in direction of the plug connector. Said guide groove may be joined at the end thereof located opposite the plug-in direction of the connector to a second guide groove, which extends in a second rotational direction and ends with one of the multiple second connector housing stops. The locking ring may thereby be easily introduced into the connector housing. The first locking ring stops may be pushed along the first guide groove opposite the plug-in direction of the connector until they reach the second guide groove. The locking ring may then be rotated in the second rotational direction until the first locking ring stops make contact with the second connector housing stops. In this position, the locking ring may be blocked such that it is not able to move either in the plug-in direction or opposite the plug-in direction of the connector.

From an injection molding point of view, the second guide groove may represent a kind of undercut. For this reason, the second guide groove may form an integral part of a hole in the connector housing. Thus, the second guide grooves can be kept free by inserts in the injection mold and the required undercut may be easy to produce.

In some embodiments, the expanding ring may comprise an engagement device on an end face, into which a tool or a triggering ring of the mating connector can engage. The engagement device can have a crown-like shape, for example. Using the tool or the triggering ring of the mating connector, the expanding ring can be rotated about the axis thereof in a first rotational direction. This may result in renewed tension of the coil spring. The engagement device therefore makes it possible to reach the open state of the plug connector again from the close state. If the expanding ring can be rotated together with the triggering ring of the mating connector, the connection between the plug connector and the mating connector can be detached again.

In order for the opening of the plug connector to be achieved in an easy and low-resistance manner, the expanding ring may have an expanding ring ramp, and the locking ring may have a locking ring ramp. These two ramps may be designed and arranged such that they may slide past each other when the expanding ring is rotated in a first rotational direction so as to arrive at the open state of the connector from the closed state.

For the coil spring to be seated against the first connector housing stop in a stable manner, the first end of the coil spring may have a substantially cuboid shape. The same can also apply to the second end of the coil spring, which may be coupled to the expanding ring.

In some embodiments, the plug contact element, in addition to the coil spring, may comprise a compressible electrically conductive sleeve, which in the closed state may be pressed together by the coil spring. To ensure the compressibility, the sleeve may be slotted, for example. The sleeve may ensure low transition resistance between the plug contact element and the mating plug contact element. Moreover, the sleeve may prevent the coil spring from damaging the mating plug contact element. The sleeve may be connected to a contact plate for establishing a connection to an electrical cable. Instead of the contact plate, a ferrule or soldering sleeve or a crimp could also be provided.

Embodiments in which the plug contact element may comprise a contact element that, perpendicular to a plug-in direction of the connector, may have a substantially semi-circular cross-section are also provided. The contact element may be connected to a contact plate for establishing a connection to an electrical cable. The described contact element may fit well in a mating plug contact element that has a substantially semi-circular cross-section.

The aforementioned sleeve and/or the described contact element can be designed and produced via bent stamping, for example. This may make these parts easy and cost-effective to produce.

According to a further aspect of the disclosure, embodiments may comprise a mating connector for electrically connecting a mating plug contact element of the mating connector to a plug contact element of a plug connector. The mating connector may comprise a triggering ring that is designed and arranged such that it presses the expanding ring of the plug connector in a plug-in direction of the mating connector when the plug connector and the mating connector are plugged into each other, whereby the plug connector switches from the open state into the closed state. Plugging these parts into each other thereby automatically triggers the coil spring, whereby the plug contact element and the mating plug contact element are electrically and mechanically connected to each other. The triggering ring may be an integral part of a mating connector housing.

The closing mechanism of the plug connector may therefore be triggered by contact of the triggering ring with the expanding ring. This may reduce a lack of stability of the strands and of the spring end potentially sliding away.

The triggering ring may be designed so as to engage in the engagement device of the expanding ring when the plug connector and the mating connector are plugged into each other. This can be achieved, for example, by the triggering ring also having a crown-like shape. Due to the engagement between the triggering ring and the engagement device of the expanding ring, the closure mechanism of the plug-in system described here can be released again by simply rotating the mating connector. The mating connector can therefore be rotated in a first rotational direction, thereby rotating the expanding ring in the same direction, whereby the plug connector switches from the closed to the open state.

Similar to the plug contact element, the mating plug contact element can have a substantially circular or substantially semi-circular cross-section perpendicular to a plug-in direction of the mating connector. The mating plug contact element may be connected to a contact plate for establishing a connection to an electrical cable. Instead of the contact plate, a ferrule or soldering sleeve or a crimp could also be provided. The aforementioned circular shape of the cross-section of the mating plug contact element lends itself when the plug contact element comprises the above-mentioned sleeve. The semi-circular cross-section of the mating plug contact element mentioned here, in contrast, may be selected when the contact element also has a semi-circular cross-section.

According to still another aspect, embodiments of the present disclosure may comprise a housing having multiple plug connectors. This housing can be a power distributor housing, for example. The connector housings of the plug connectors can be joined to the housing in one piece, by bonding or by positive fit. A detent connection may lend itself for a positive fit joint. Such a housing can be prepared so that all plug connectors are in the open state. Corresponding mating connectors can then be easily introduced into the plug connectors, whereby the plug connectors become closed.

BRIEF DESCRIPTION OF THE FIGURES

Further details and related advantages of embodiments of the present disclosure will be described hereafter with reference to the figures.

DETAILED DESCRIPTION

Figure 1A:
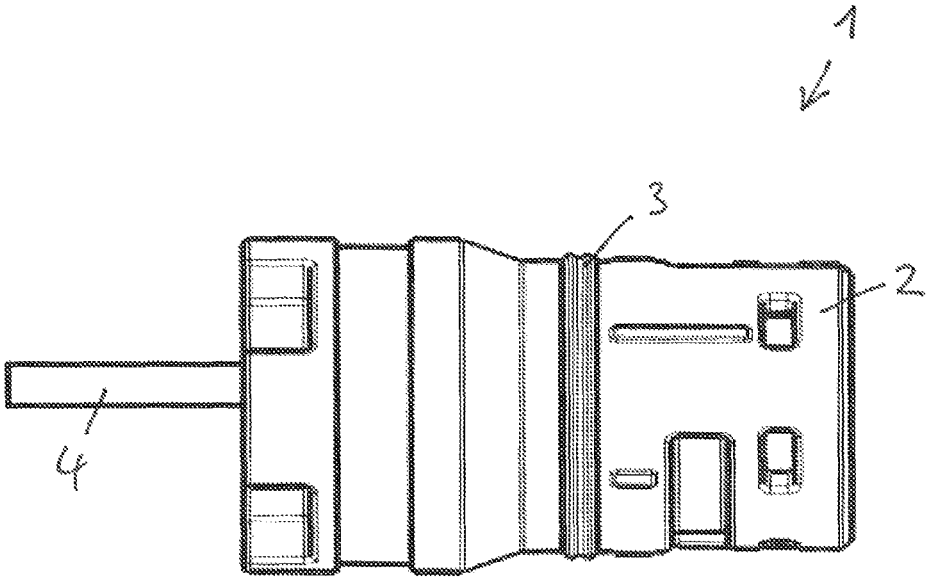
FIG. 1A shows a side view of an exemplary plug connector according to the present disclosure.

In the following, identical and like acting elements are denoted by the same reference numerals, unless indicated otherwise.

FIG. 1A shows an exemplary plug connector 1 according to the disclosure. The plug connector 1 comprises a connector housing 2 having a sealing ring 3 so as to be able to establish a connection with a mating connector that is waterproof. On the outgoing cable side, the plug connector 1 comprises a contact plate 4 to which a cable can be welded, for example by way of ultrasonic welding.

Figure 1B:
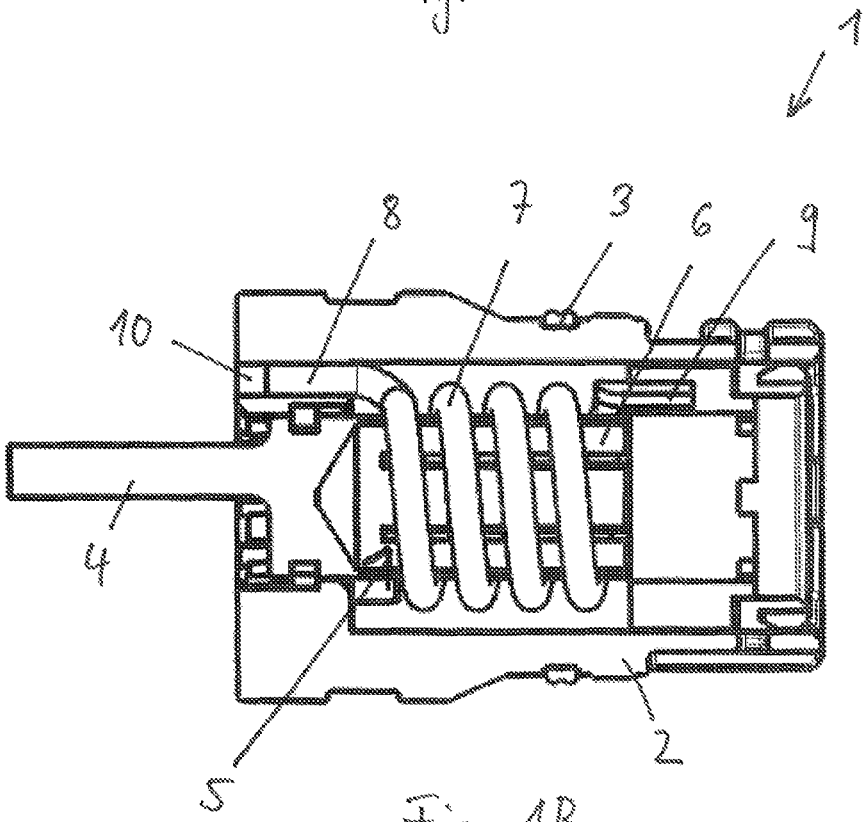
FIG. 1B shows a sectional illustration of the plug connector from FIG. 1A.

FIG. 1B shows the plug connector 1 again in a sectional illustration. As shown in FIG. 1B, the plug connector 1 further comprises a plug contact element 5, which includes an inside sleeve 6 and a coil spring 7 surrounding the sleeve 6. The sleeve 6 is connected to the contact plate 4. The coil spring 7 has a first end 8 and a second end 9. The first end 8 of the coil spring 7 is seated against a first connector housing stop 10, which may prevent the first end 8 from being rotated in a first rotational direction.

Figure 2A:
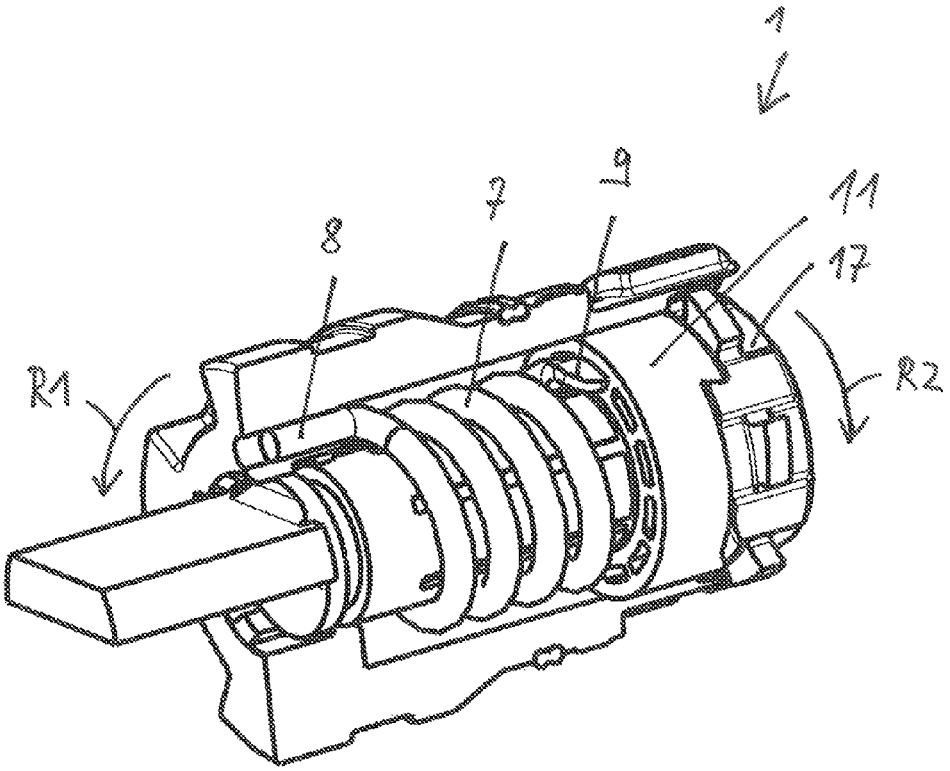
FIG. 2A shows the sectional illustration from FIG. 1B in a perspective view, the plug connector being in the open state.

The sectional illustration from FIG. 1B is shown again in a perspective view in FIG. 2A. As shown in FIG. 2A, the second end 9 of the coil spring 7 is coupled to an expanding ring 11.

Figure 4A:
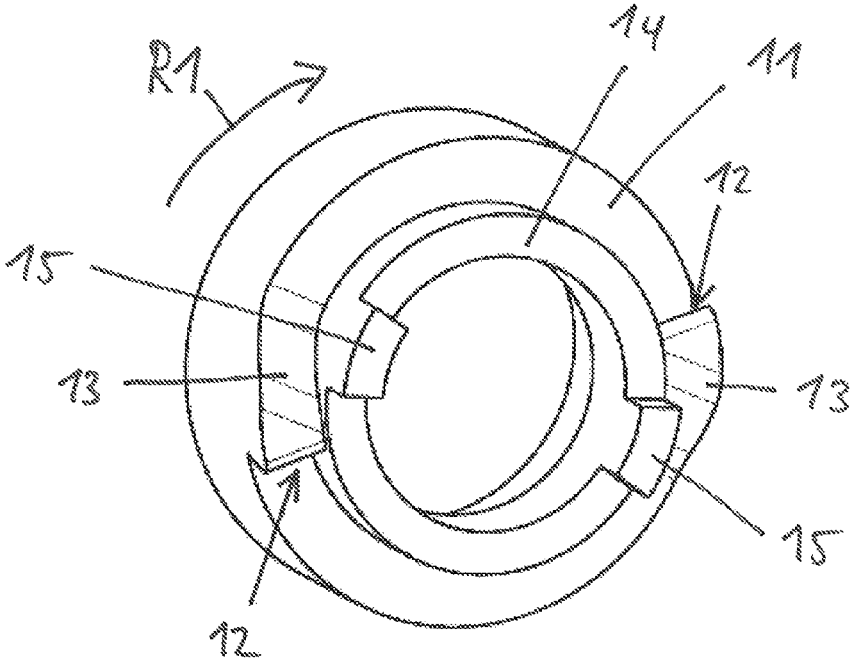
FIG. 4A is a view of an exemplary expanding ring from the front.
Figure 4B:
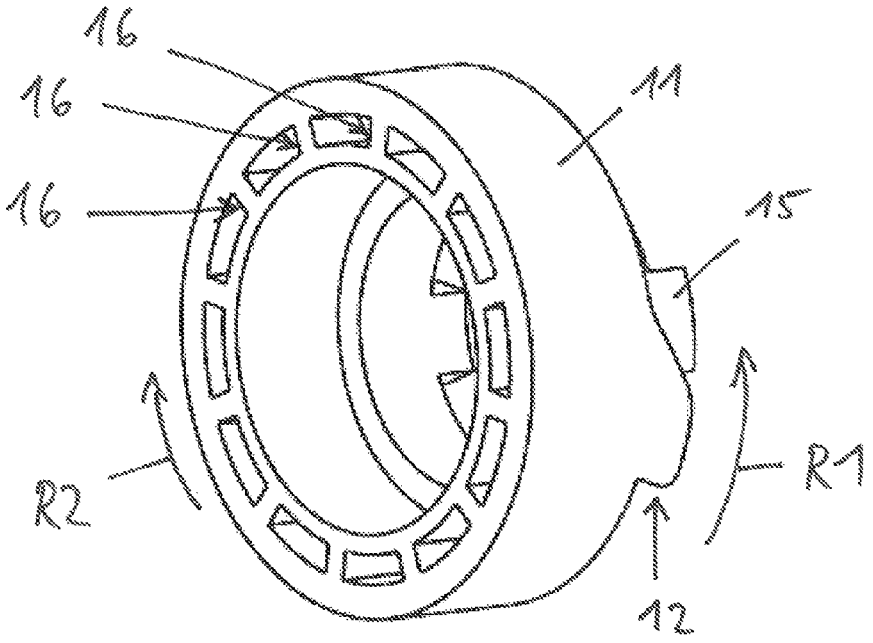
FIG. 4B is a view of the expanding ring from FIG. 4A from the back.

This expanding ring 11 is described in more detail with reference to FIGS. 4A and 4B. FIG. 4A shows the expanding ring 11 from a front, which is the end face mentioned above. The expanding ring 11 comprises two first expanding ring stops 12, each being joined to an expanding ring ramp 13. The first expanding ring stops 12 are provided to absorb a pressure in a first rotational direction R1. At the end face, the expanding ring 11 comprises an engagement device 14, which in the present example has two crown prongs 15. At the back of the expanding ring 11 shown in FIG. 4B, the expanding ring 11 has multiple second expanding ring stops 16 for absorbing a pressure in the second rotational direction R2. As is apparent from FIG. 2A, only a single one of the second expanding ring stops 16 is used as a bearing point for the second end 9 of the coil spring 7.

Figure 5A:
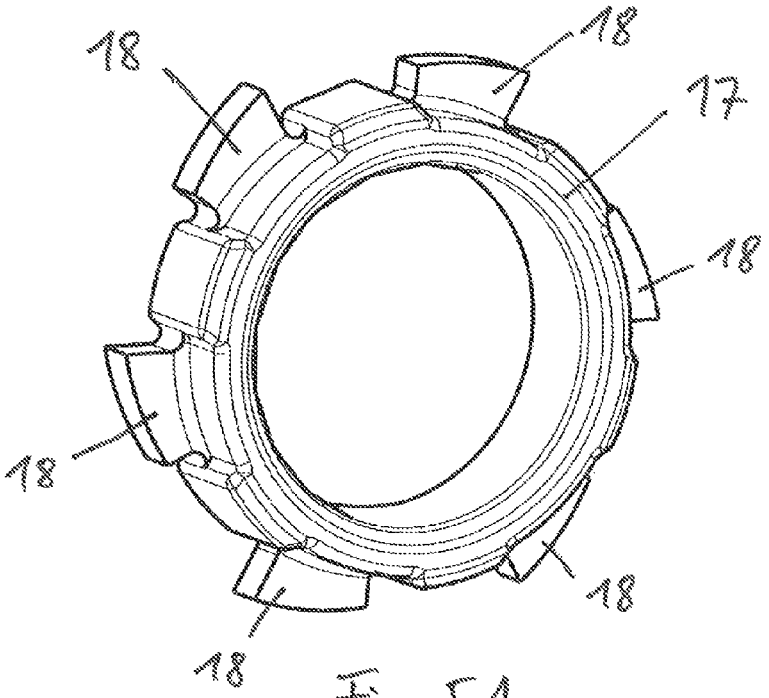
FIG. 5A is a view of an exemplary locking ring from the front.
Figure 5B:
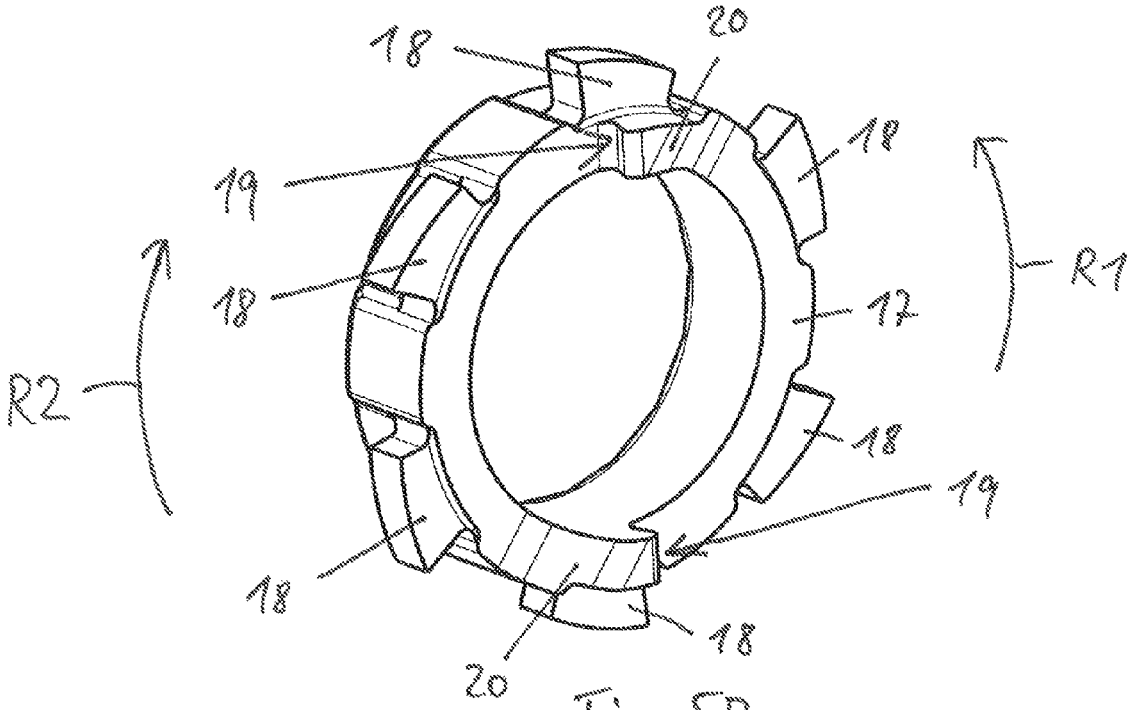
FIG. 5B is a view of the locking ring from FIG. 5A from the back.

In the open state of the plug connector 1 shown in FIG. 2A, a rotation of the expanding ring 11 is blocked by a locking ring 17, the features of which is described in more detail with reference to FIGS. 5A and 5B. FIG. 5A shows the locking ring 17 from the front. The locking ring 17 has multiple first locking ring stops 18 for absorbing a pressure in the first rotational direction R1. At the back, which is shown in FIG. 5B, the locking ring 17 additionally has two second locking ring stops 19 for absorbing a pressure in the second rotational direction R2 opposite to R1. Each of these second locking ring stops 19 is joined to a locking ring ramp 20.

Figure 2B:
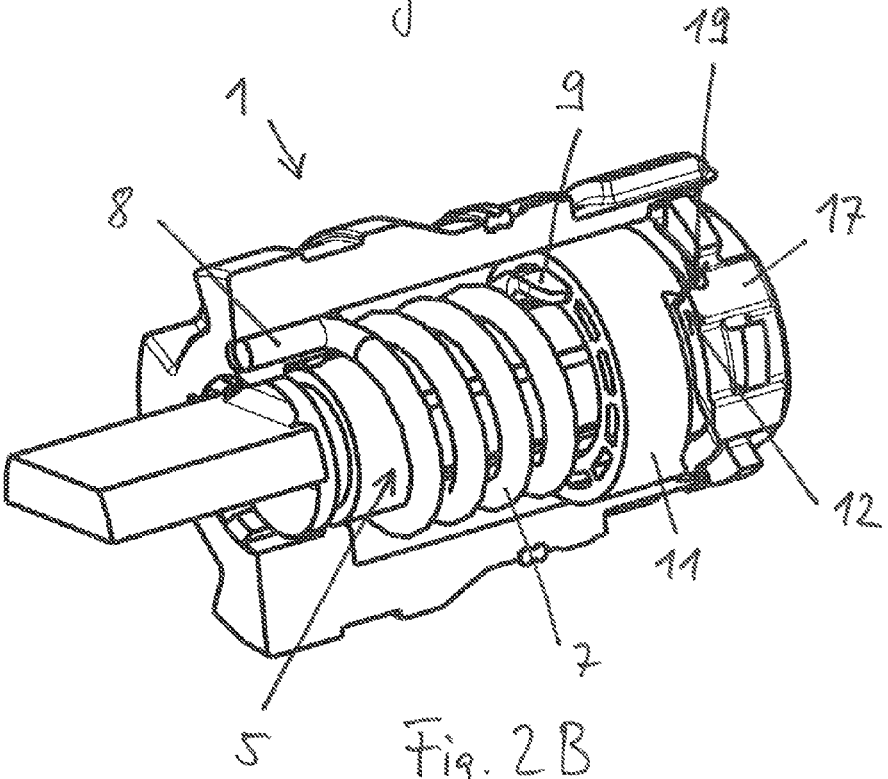
FIG. 2B shows the illustration from FIG. 2A, the expanding ring being pressed in a plug-in direction of the mating connector.

FIG. 2B shows the plug connector 1 from FIG. 2A again in a trigger situation. The expanding ring 11 is pressed in a plug-in direction of the mating connector so that the expanding ring 11 is decoupled from the second locking ring stop 19. The first expanding ring stop 12 therefore no longer makes contact with the second locking ring stop 19.

Figure 2C:
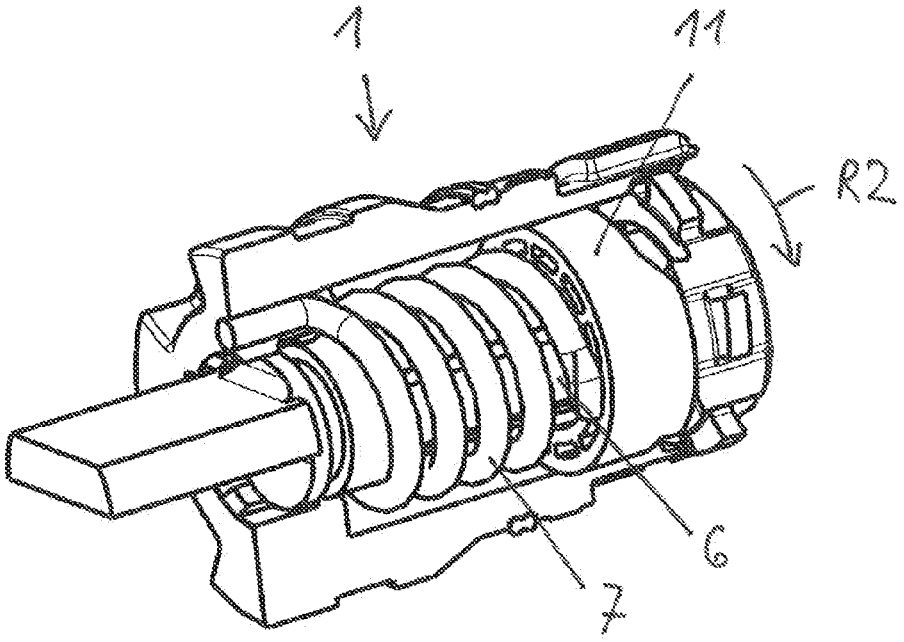
FIG. 2C shows the plug connector from FIG. 2B in the closed state.

FIG. 2C shows the plug connector 1 again in the closed state. Compared to the illustration in FIG. 2B, the expanding ring 11 has rotated in the second rotational direction R2. As a result, the coil spring 7 presses onto the sleeve 6.

Figure 3:
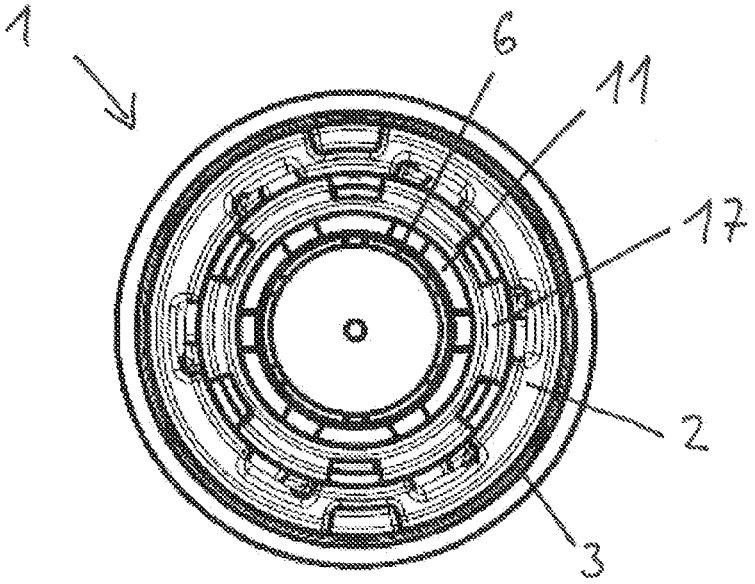
FIG. 3 is a view onto the connector face of the plug connector.

FIG. 3 shows the plug connector 1 again with a view onto the connector face. In this way, the sleeve 6 is visible. The engagement device 14 of the expanding ring 11 follows in the direction from the center outward. Adjoining thereto, the locking ring 17 can be seen, which is arranged in the connector housing 2. The sealing ring 3 is also apparent.

Figure 6:
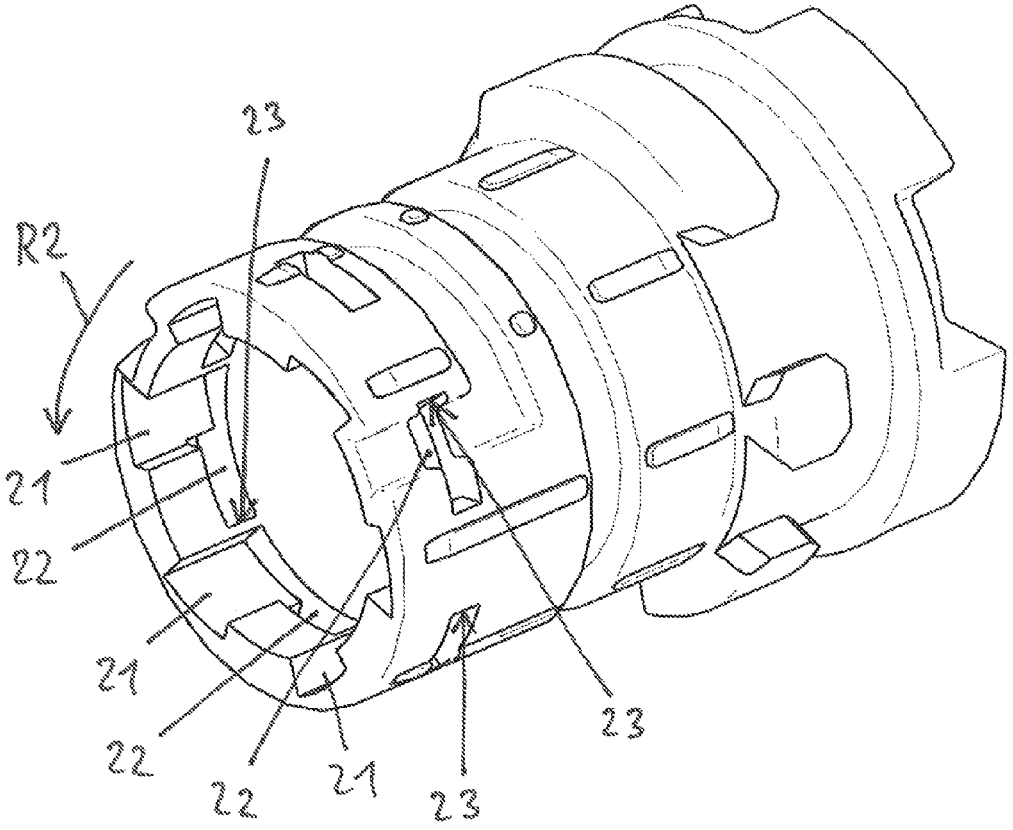
FIG. 6 shows the connector housing of the plug connector.

The connector housing 2 is shown again in detail in FIG. 6. For each first locking ring stop 18, the connector housing 2 has a first guide groove 21 extending in a plug-in direction of the plug connector. At the end located opposite the plug-in direction of the connector, this groove is connected to a second guide groove 22. Said second guide groove 22 extends in the second rotational direction R2 and ends with one of the multiple second connector housing stops 23. The second guide grooves 22 are part of a hole in the connector housing 2. When the locking ring 17 is introduced into the connector housing 2, the first locking ring stops 18 undergo guidance by the first guide grooves 21. The locking ring 17 is subsequently rotated in the second rotational direction R2 until the first locking ring stops 18 are seated against the second connector housing stops 23.

Figure 7A:
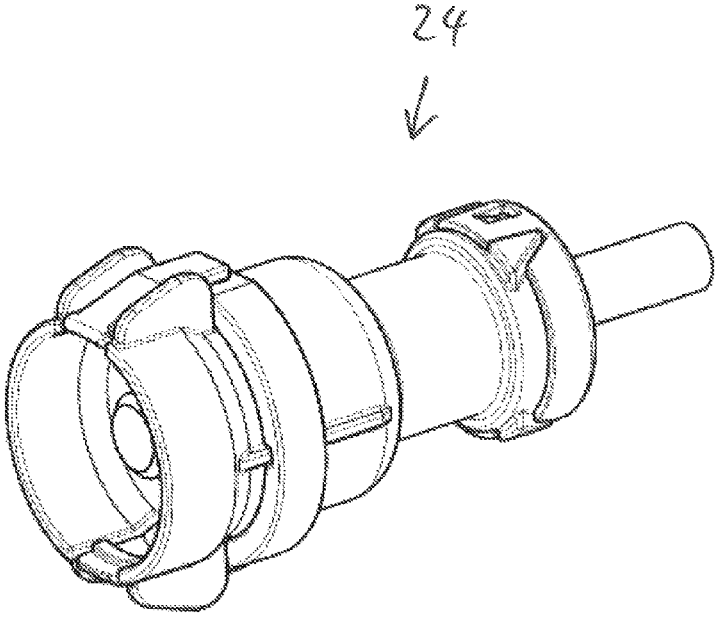
FIG. 7A shows a perspective view of an exemplary mating connector according to the present disclosure.
Figure 7B:
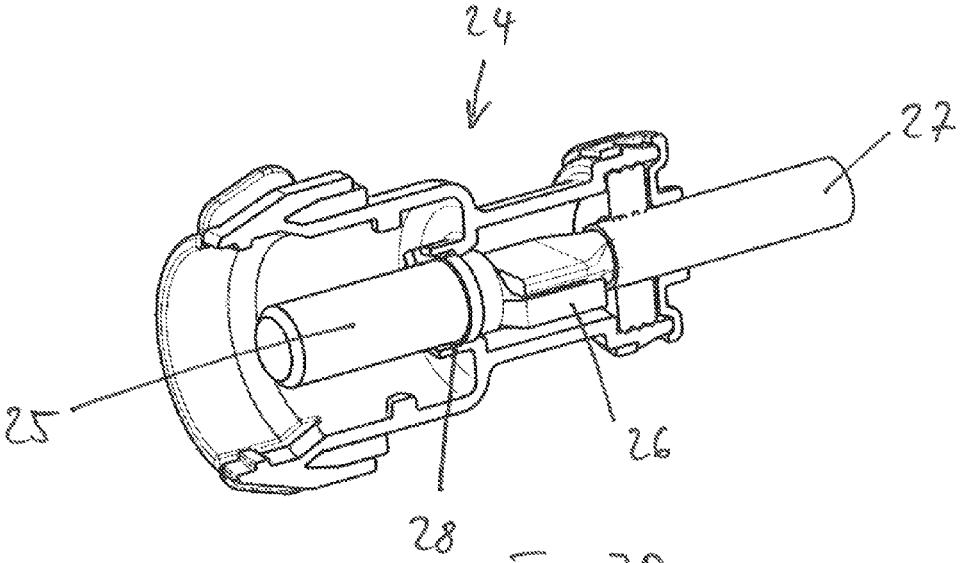
FIG. 7B shows a sectional view through the mating connector from FIG. 7A.

FIG. 7A shows an exemplary mating connector 24 according to the disclosure. As is shown in the sectional illustration of FIG. 7B, the mating connector 24 has a mating plug contact element 25, which has a circular cross-section perpendicular to a plug-in direction of the mating connector. The mating plug contact element 25 is connected to a contact plate 26, to which an electrical cable 27 is welded. A triggering ring 28 is arranged around the mating plug contact element 25 and is designed and arranged so as to press the expanding ring 11 of the plug connector 1 in a plug-in direction of the mating connector when the plug connector 1 and the mating connector 24 are plugged into each other, whereby the plug connector 1 switches from the open state into the closed state.

Figure 8A:
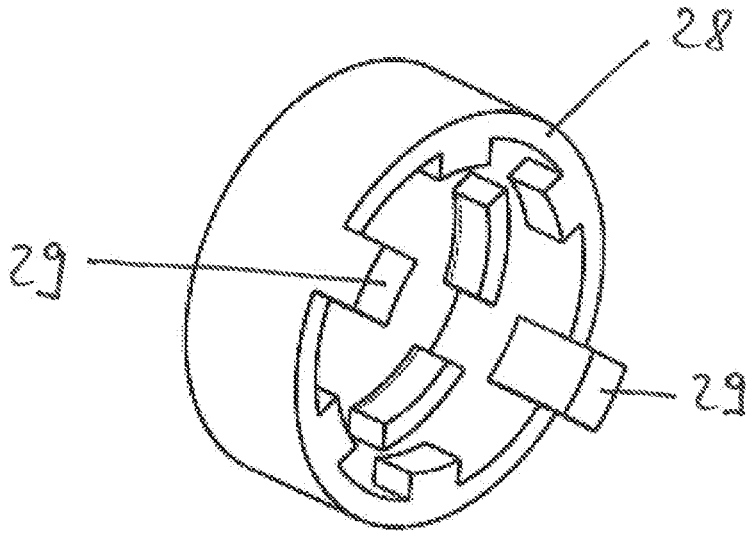
FIG. 8A shows an exemplary triggering ring of the mating connector.
Figure 8B:
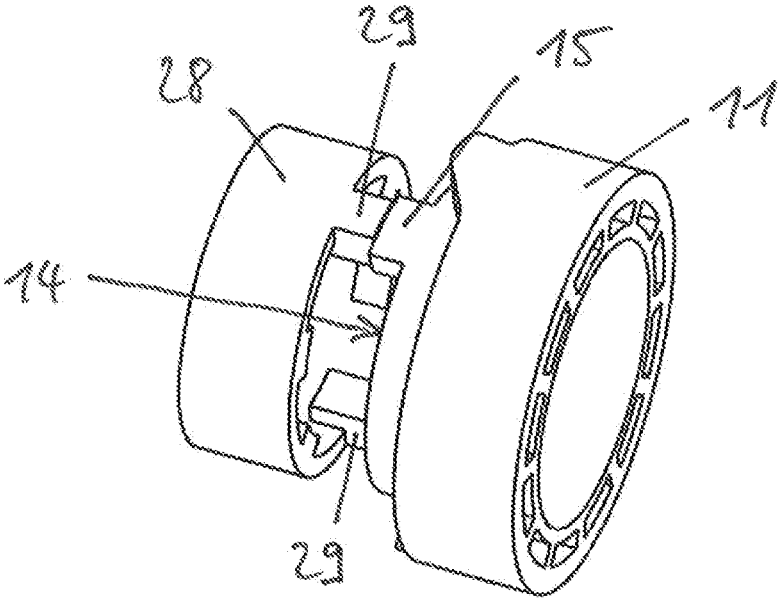
FIG. 8B shows the triggering ring from FIG. 8A when it presses the expanding ring in the plug-in direction of the mating connector.
Figure 8C:
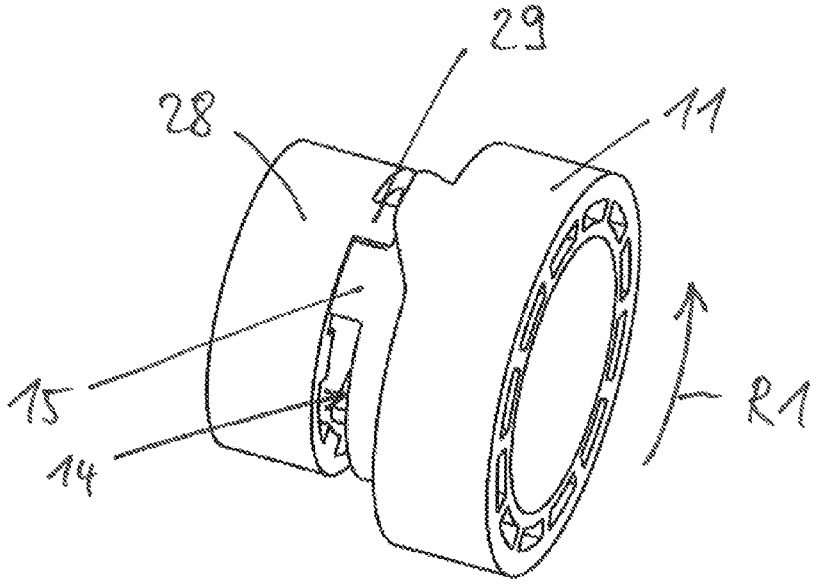
FIG. 8C shows the triggering ring in engagement with the engagement device of the expanding ring.

The triggering ring 28 is shown again in detail in FIG. 8A. It has a crown-like shape comprising two crown prongs 29, which press against the crown prongs 15 of the engagement device 14 of the expanding ring 11 when the plug connector 1 and the mating connector 24 are plugged into each other, as shown in FIG. 8B. When the plug connector 1 and the mating connector 24 are plugged into each other and the expanding ring 11 has rotated in the second rotational direction R2, the triggering ring 28 and the expanding ring 11 are engaged with each other. This means, as can be seen in FIG. 8C, that the crown prongs 29 of the triggering ring 28 are situated next to the crown prongs 15 of the engagement device 14 of the expanding ring 11. This arrangement causes a rotation of the triggering ring 28 in the first rotational direction R1 to also result in a rotation of the expanding ring 11 in the first rotational direction R1. In this way, the plug connector 1 can be opened again.

Figure 9A:
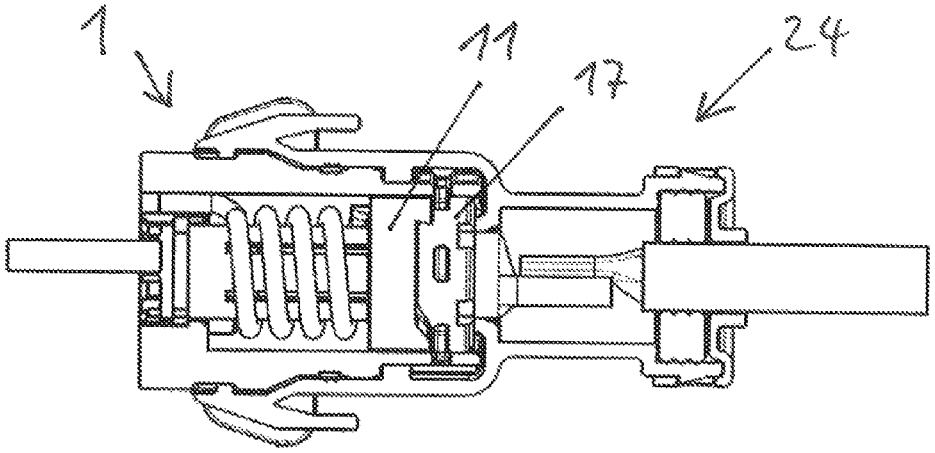
FIG. 9A shows a sectional illustration of the plug connector with the mating connector, the plug connector being in the open state.
Figure 9B:
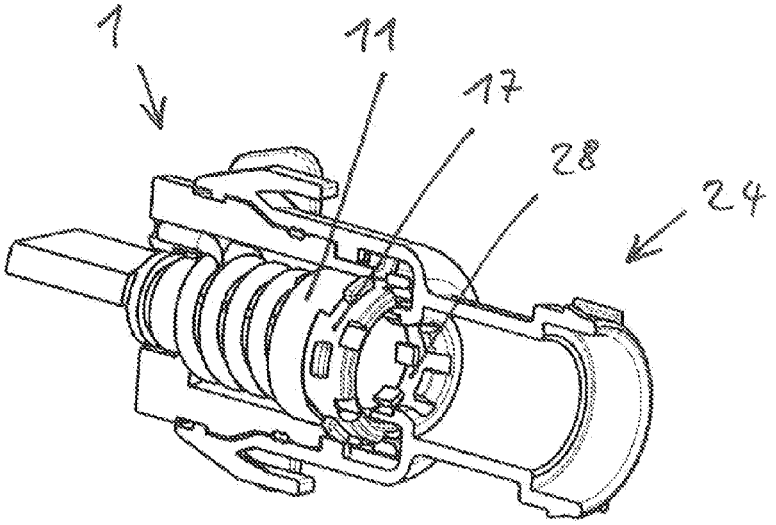
FIG. 9B shows a perspective view of the sectional view from FIG. 9A.

FIGS. 9A and 9B represent a sectional view of a plug connector 1 and of the mating connector 24 in two different perspectives. The plug connector 1 is still in the open state. As can be seen particularly well in FIG. 9B, the triggering ring 28 presses through the locking ring 17 and onto the expanding ring 11.

Figure 10A:
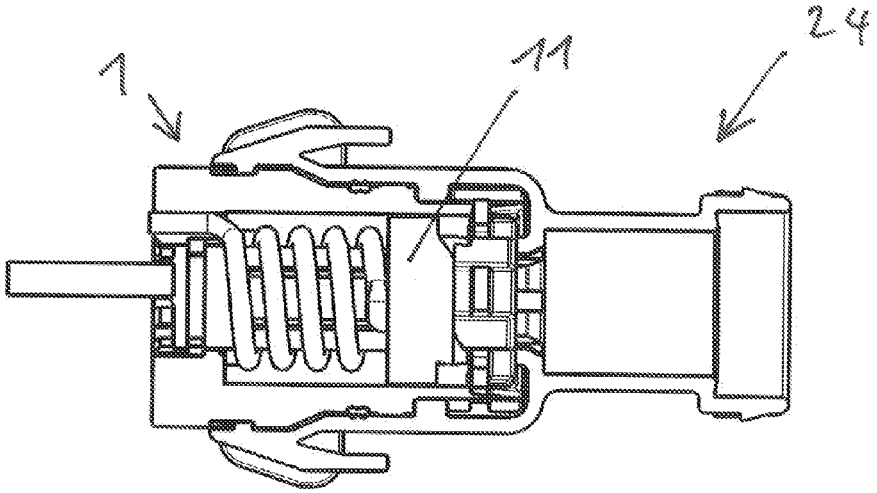
FIG. 10A shows a sectional view through the plug connector and the mating connector, said plug connector being in the closed state.
Figure 10B:
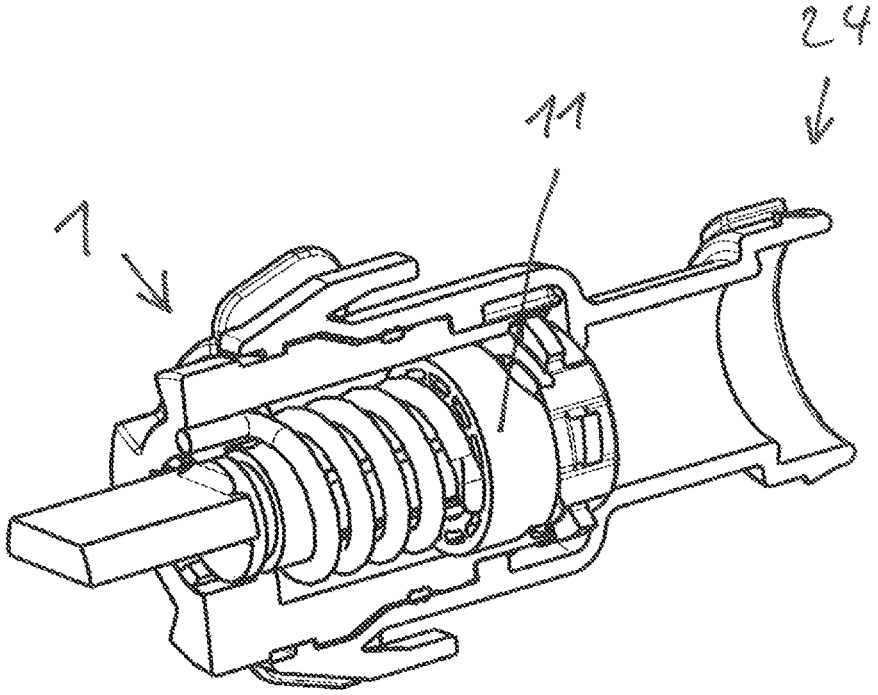
FIG. 10B shows the sectional view from FIG. 10A in a perspective view.

FIGS. 10A and 10B show the plug connector 1 again together with the mating connector 24 in the closed state. The triggering ring 28 engages in the engagement device 14 of the expanding ring 11.

Figure 11A:
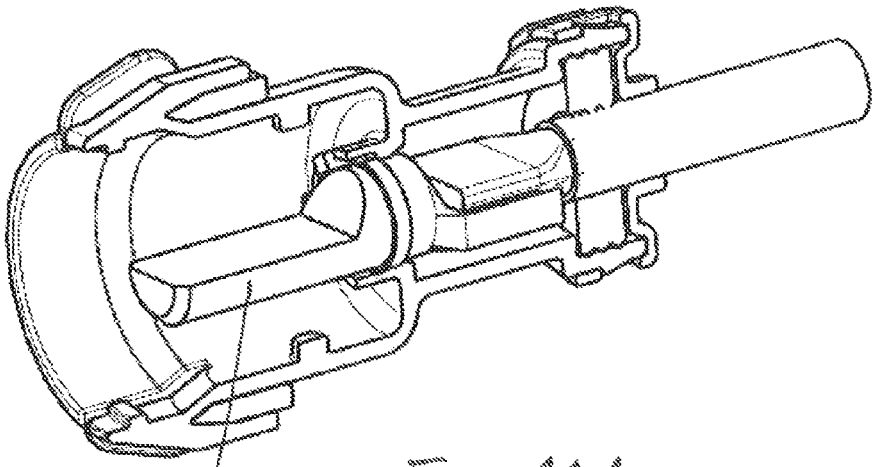
FIG. 11A shows another exemplary mating plug contact element.
Figure 11B:
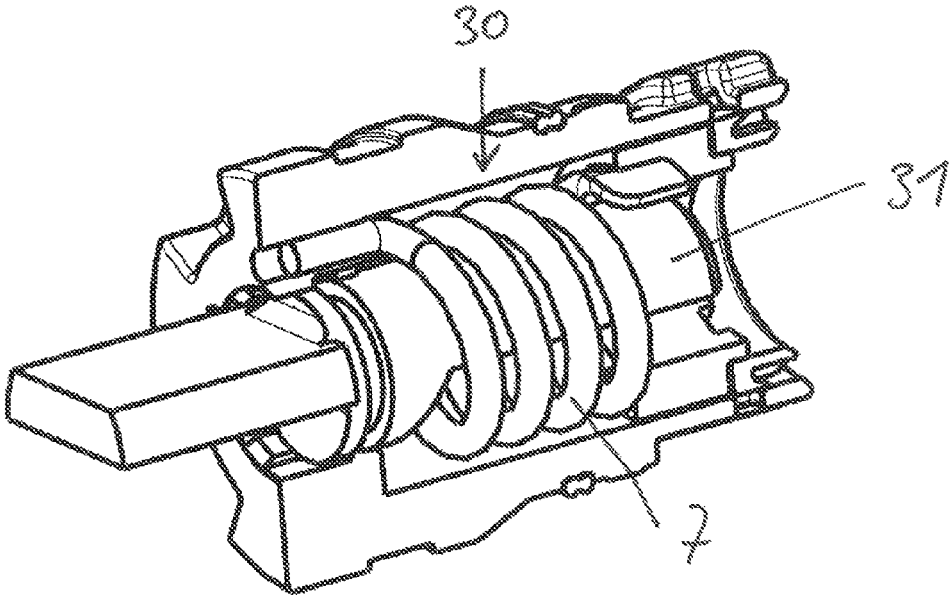
FIG. 11B shows another exemplary plug contact element.

FIGS. 11A and 11B illustrate another exemplary plug contact element 30 and another exemplary mating plug contact element 32. As shown in FIG. 11B, the plug contact element 30 comprises a contact element 31 that, perpendicular to a plug-in direction of the connector, has a semi-circular cross-section. The complementary mating plug contact element 32 is shown in FIG. 11A. The mating plug contact element 32 also has a semi-circular cross-section, perpendicular to a plug-in direction of the mating connector, and can therefore be easily introduced into the coil spring 7 shown in FIG. 11B.

Figure 12A:
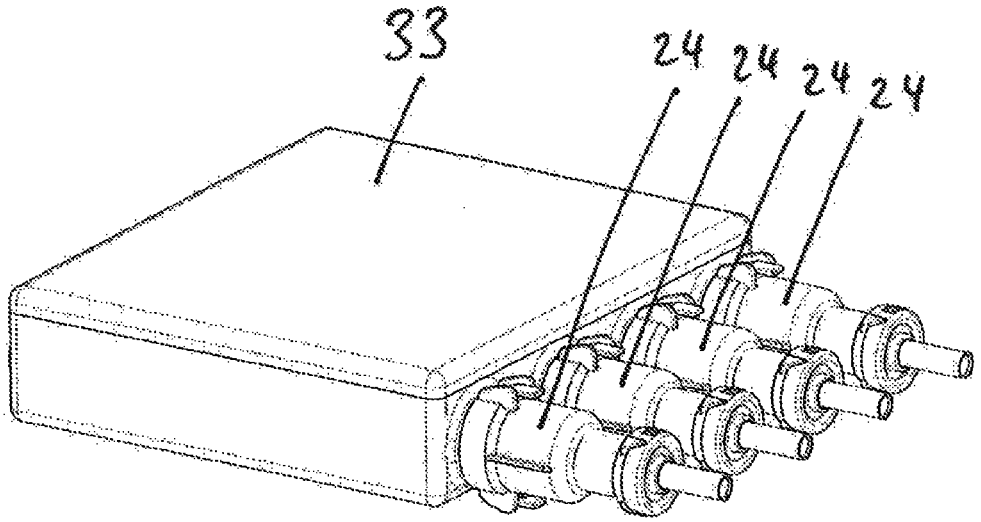
FIG. 12A shows an exemplary housing according to the present disclosure.
Figure 12B:
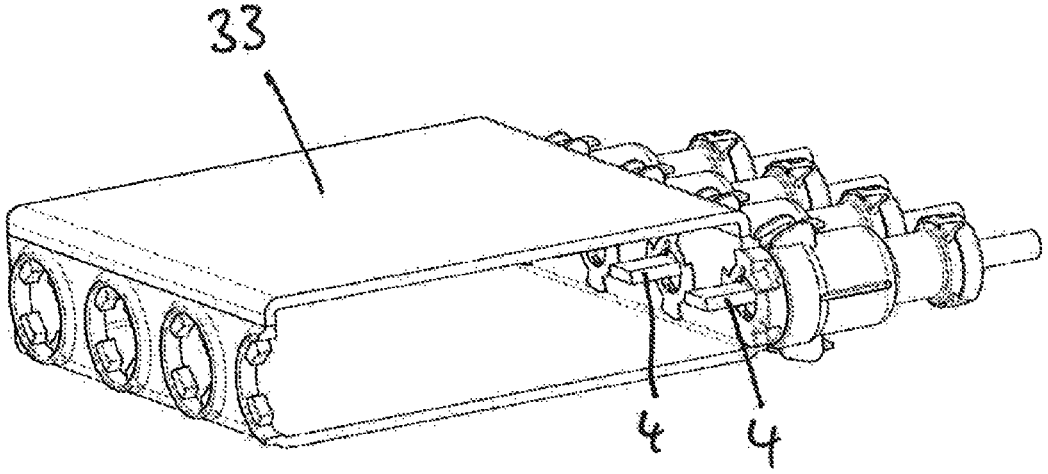
FIG. 12B shows a sectional view through the housing from FIG. 12A.

FIG. 12A shows a power distributor housing 33 according to embodiments of the present disclosure. It is bonded to multiple plug connectors according to the present disclosure, on each of which a mating connector 24 is arranged. As is apparent from the sectional illustration through the housing 33 in FIG. 12B, the contact plates 4 of the plug connectors protrude into an interior of the power distributor housing 33, where they can be welded to a cable, a lead frame or a bus bar.

The explanations provided with reference to the figures are purely illustrative and shall not be understood to have any limiting effect. It is possible to make a large number of modifications to the described embodiments without departing from the scope of protection as it is defined in the accompanying claims.

LIST OF REFERENCE NUMERALS

1 plug connector
2 connector housing
3 sealing ring
4 contact plate
5 plug contact element
6 sleeve
7 coil spring
8 first end of the coil spring
9 second end of the coil spring
10 first connector housing stop
11 expanding ring
12 first expanding ring stop
13 expanding ring ramp
14 engagement device
15 crown prong
16 second expanding ring stop
17 locking ring
18 first locking ring stop
19 second locking ring stop
20 locking ring ramp
21 first guide groove
22 second guide groove
23 second connector housing stop
24 mating connector
25 mating plug contact element
26 contact plate
27 cable
28 triggering ring
29 crown prong
30 plug contact element
31 contact element
32 mating plug contact element
33 power distributor housing
R1 first rotational direction
R2 second rotational direction

The invention claimed is:

1. A plug connector comprising:

an expanding ring;

a plug contact element comprising a coil spring with a first end and a second end, wherein the second end of the coil spring is coupled to the expanding ring;

a first connector housing stop configured to absorb a pressure in a first rotational direction and block the first end of the coil spring from rotating in the first rotational direction; and a locking ring configured to absorb a pressure in a second rotational direction opposite the first rotational direction, wherein the locking ring is configured to:

block the expanding ring when the plug connector is in an open state, and unblock the expanding ring when the plug connector is in a closed state.

2. The plug connector according to claim 1, wherein the coil spring is configured to be contracted when the plug connector is in the closed state such that that a pressure of the coil spring connects the plug contact element and a mating plug contact element of a mating connector to each other.

3. The plug connector according to claim 1, wherein the expanding ring is configured to be pressed by a mating connector in a plug-in direction of the mating connector when the plug connector is in the open state.

4. The plug connector according to claim 1, wherein the expanding ring comprises:

a first expanding ring stop configured to absorb the pressure in the first rotational direction; and a second expanding ring stop configured to absorb the pressure in the second rotational direction.

5. The plug connector according to claim 4, wherein the first expanding ring stop is configured to:

seat against a locking ring stop of the locking ring when the plug connector is in the open state, and decouple from the locking ring stop when the plug connector is in the closed state.

6. The plug connector according to claim 1, further comprising:

a connector housing, the connector housing comprising the first connector housing stop and a second connector housing stop, wherein the second connector housing stop is configured to absorb the pressure in the second rotational direction.

7. The plug connector according to claim 6, wherein the connector housing comprises a plurality of second connector housing stops.

8. The plug connector according to claim 6, wherein the connector housing comprises a first guide groove extending in a plug-in direction of the plug connector, and a second guide groove extending in the second rotational direction.

9. The plug connector according to claim 8, wherein the second guide groove forms a hole in the connector housing.

10. The plug connector according to claim 1, wherein the expanding ring comprises an engagement device configured to engage with a tool or a mating connector, the tool or the mating connector being configured to enable, via the engagement device, the expanding ring to rotate in the first rotational direction about an axis of the expanding ring.

11. The plug connector according to claim 10, wherein the expanding ring and the locking ring are configured to slide past each other when the expanding ring is rotated in the first rotational direction.

12. The plug connector according to claim 1, wherein the first end and the second end of the coil spring have a substantially cuboid shape.

13. The plug connector according to claim 1, wherein the plug contact element comprises a compressible sleeve.

14. The plug connector according to claim 1, wherein the plug contact element comprises a substantially semi-circular cross-section.

15. A mating connector comprising:

a mating plug contact element configured to be connected to a plug contact element of a plug connector; and a triggering ring arranged around the mating plug contact element and configured to press an expanding ring of the plug connector in a plug-in direction of the mating connector and switch the plug connector from an open state to a closed state.

16. The mating connector according to claim 15, wherein the triggering ring is configured to engage an engagement device of the expanding ring when the plug connector and the mating connector are plugged into each other.

17. The mating connector according to claim 15, wherein the mating plug contact element has a substantially circular or substantially semi-circular cross-section.

18. A power distributor, comprising:

a housing; and a plurality of plug connectors, each of the plug connectors including:

an expanding ring;

a plug contact element comprising a coil spring with a first end and a second end, wherein the second end of the coil spring is coupled to the expanding ring;

a connecting housing having a first connector housing stop configured to absorb a pressure in a first rotational direction and block the first end of the coil spring from rotating in a first rotational direction; and a locking ring configured to absorb a pressure in a second rotational direction opposite the first rotational direction, wherein the locking ring is configured to:

block the expanding ring when the plug connector is in an open state, and unblock the expanding ring when the plug connector is in a closed state, wherein the connector housing of each of the plug connectors is joined to the housing a detent connection.

* * * * *